US006609881B2

(12) United States Patent
Brown et al.

(10) Patent No.: US 6,609,881 B2
(45) Date of Patent: Aug. 26, 2003

(54) STEAM TURBINE INLET AND METHODS OF RETROFITTING

(75) Inventors: Daniel Mark Brown, Altamont, NY (US); George Horner Kirby, Charlton, NY (US); Andrew Ivan Christopher Hunter, Cohoes, NY (US); Richard Lloyd Mattice, Broadalbin, NY (US); Brian E. Thompson, London (CA)

(73) Assignee: General Electric Company, Schenectady, NY (US)

( * ) Notice: Subject to any disclaimer, the term of this patent is extended or adjusted under 35 U.S.C. 154(b) by 15 days.

(21) Appl. No.: 09/987,695

(22) Filed: Nov. 15, 2001

(65) Prior Publication Data

US 2003/0091431 A1 May 15, 2003

(51) Int. Cl.[7] ..... F01D 9/02
(52) U.S. Cl. ..... 415/102; 415/185
(58) Field of Search ..... 415/102, 103, 415/183, 185, 167, 116, 202; 29/888.021

(56) References Cited

U.S. PATENT DOCUMENTS 3,038,699 A * 6/1962 Kaplan
3,610,770 A * 10/1971 Hendriks ..... 415/159
3,861,821 A * 1/1975 Keller et al. ..... 415/101
4,025,229 A * 5/1977 Browning et al. ..... 415/216
4,027,996 A * 6/1977 Keller et al. ..... 415/116
4,097,188 A * 6/1978 Forster ..... 415/202
5,215,436 A * 6/1993 Puzyrewski ..... 415/202
5,593,273 A 1/1997 Brinkman
5,601,405 A * 2/1997 Coates ..... 415/202
5,927,943 A * 7/1999 Maier ..... 415/167
6,386,829 B1 * 5/2002 Vitone, Jr. et al. ..... 415/185

* cited by examiner

*Primary Examiner*—Edward K. Look
*Assistant Examiner*—James M. McAleenan
(74) *Attorney, Agent, or Firm*—Nixon & Vanderhye

(57) ABSTRACT

A pair of steam turbine inlet ports are disposed at opposite sides of a steam turbine housing for flowing steam in opposite circumferential directions in a generally annular steam chamber to first stages of a turbine through axially opposite outlets. Portions of the chamber in the upper and lower housing have decreasing cross-sections in a generally circumferential direction away from the steam inlet portions to provide a substantially uniform flow of steam about the chamber in a generally radially inward direction and about and through the axial outlets.

16 Claims, 6 Drawing Sheets

STEAM TURBINE INLET AND METHODS OF RETROFITTING

BACKGROUND OF THE INVENTION

The present invention relates to a steam turbine inlet for providing substantially uniform mass flow and velocity as the steam flows axially into the first stage(s) and particularly relates to a steam inlet having a linearly varying cross-sectional area in a circumferential direction from inlet ports adjacent the horizontal midline to upper and lower vertical centerlines of the fixed casing whereby losses due to non-uniform flow are minimized or eliminated. The present invention also relates to a method of retrofitting existing steam turbines to provide a uniform mass flow and velocity in the inlet to the first stage nozzles.

In steam turbines, for example, low pressure steam turbines, feed steam from a high pressure section flows into a low pressure steam inlet, typically including a pair of inlet ports generally on opposite sides of the turbine housing and an annulus. The steam flow through each steam inlet port splits in opposite circumferential directions for flow through arcuate sections of the annulus, which typically have a constant cross-sectional area. As the flow follows the circumferential path of the inlet annulus, the steam feeds radially inwardly and turns axially into the first stage nozzles. In split flow axial steam turbines, the radial inward flow from the annulus splits for flow in opposite axial directions to the first stage nozzles.

Ideally, the low pressure inlet turns the steam 90° into axial flows with minimum loss. However, with an annulus of constant cross-sectional area within the housing in communication with steam inlet ports, considerable energy losses occur due to a decrease in steam velocity as it traverses the circumferential extent of the annulus in directions away from the inlet ports. With a substantially constant cross-sectional flow area about the annulus, the mass flow is not constant and a non-uniform velocity profile at the axial inlet(s) to the first stage nozzles occurs. Accordingly, there is a need for an improved steam inlet for a steam turbine wherein the steam flow will maintain uniformity throughout the inlet, thereby eliminating losses due to non-uniform flow and affording a substantially uniform velocity profile as the steam enters the first stage nozzles.

BRIEF SUMMARY OF THE INVENTION

In accordance with a preferred embodiment of the present invention, there is provided a steam inlet configured to provide a uniform mass flow of steam at substantially uniform velocity in radial inward and axial directions for delivery to the first stage nozzles. To achieve this relatively constant mass flow and uniform velocity profile, the inlet includes an annular casing defining a chamber of substantially progressively reduced cross-sectional area in a generally circumferential direction away from the steam inlet ports. By progressively decreasing the cross-sectional area, mass flow and uniform velocity are substantially achieved.

Particularly, in a preferred embodiment of the present invention, there is provided a split flow axial steam turbine having a casing defined by outer peripheral and side walls in communication with steam inlet ports generally along opposite sides of the turbine housing adjacent the horizontal midline. The steam flow through the inlet ports splits for flow along upper and lower portions of the chamber defined by the casing. The cross-sectional area of the chamber decreases in a direction away from each inlet port to a minimum cross-section at locations substantially medially between the steam inlet ports along opposite circumferential steam flow paths in upper and lower housings containing portions of the chamber. The casing thus generally provides quadrants of steam flow passages of progressively reduced cross-sectional areas from the inlet ports to minimum cross-sectional areas approximately 90° away from the inlet ports. By progressively reducing the cross-sectional area, the mass flow and velocity remain substantially uniform in radial inward and axial directions, thereby reducing energy losses.

The steam inlet casing may be provided as part of original equipment manufacture or may be provided as a retrofit to existing steam turbine inlets. In the latter case, the annulus defined by the original steam turbine housing may be provided with one or more arcuate unitary casings having outer peripheral and side walls defining the progressively reduced cross-sectional flow passage about the rotor. The casings can be preformed, for example, for installation in each quadrant, or the walls of the casings can be fabricated and secured individually to the turbine housing to define flow passages of progressively decreasing cross-sectional area in a direction away from the steam inlet ports.

In a preferred embodiment according to the present invention, there is provided in a steam turbine, a steam inlet comprising a generally annular casing having an outer surrounding peripheral wall and a pair of axially spaced side walls extending inwardly to define a generally annular chamber within the casing and at least one generally annular steam outlet generally centrally of the casing in communication with the chamber for flowing steam axially outwardly through the outlet into the first stage of the turbine, a pair of steam inlet ports spaced from one another about the casing for receiving steam and transmitting steam into the chamber, the chamber having a substantially progressive reduction in cross-sectional area in a generally circumferential direction away from the steam inlet ports to provide a substantially uniform flow of steam about the chamber in a generally radially inward direction.

In a further preferred embodiment according to the present invention, there is provided in a split flow axial steam turbine, a steam inlet comprising a generally annular casing having an outer surrounding peripheral wall and a pair of axially spaced side walls extending inwardly from the outer wall to define a generally annular chamber within the housing, a pair of steam inlet ports spaced from one another about the casing for receiving steam and flowing the received steam into the chamber, a pair of axially spaced, generally annular steam outlets in communication with the chamber for flowing steam in opposite axial directions through the outlets to stages of the turbine, the chamber having a progressive reduction in cross-sectional area in a generally circumferential direction away from the steam inlet ports to provide a generally uniform flow of steam from the chamber through and about the steam outlets.

In a further preferred embodiment according to the present invention, there is provided in a split flow axial steam turbine having a housing with an annulus for receiving steam from a pair of circumferentially spaced steam inlet ports and a pair of axially spaced steam outlets radially inwardly of the annulus for receiving steam from the annulus for flow in opposite axial directions to stages of the turbine, a retrofit steam chamber for the annulus, comprising a plurality of generally arcuate casings each having an outer peripheral wall and a pair of axially spaced side walls extending inwardly from the outer wall to define a generally arcuate passage, the arcuate casings being disposed within the annulus in communication with the steam inlet ports, respectively, each of the arcuate passages having a progressive reduction in cross-sectional area in a generally circumferential direction away from the steam inlet ports to provide a generally uniform flow of steam from the chamber through and about the steam outlets.

In a further preferred embodiment according to the present invention, there is provided in a split flow axial steam turbine having a housing with an annulus for receiving steam from a pair of circumferentially spaced steam inlet ports and a pair of axially spaced steam outlets radially inwardly of the annulus for receiving steam from the annulus for flow in opposite axial directions to stages of the turbine, a method of retrofitting a steam inlet to obtain a generally uniform velocity of steam flowing axially through and about the steam outlets, comprising the steps of forming a plurality of arcuate casings each having an outer peripheral wall and a pair of axially spaced side walls extending inwardly from the outer wall to define a generally arcuate steam flow passage of decreasing cross-sectional area from one end to an opposite end, installing the casings as unitary casings or as discrete peripheral walls and side walls in the annulus of the housing with larger cross-sectional ends thereof in communication with the inlet ports and with passages in communication with the axial steam outlets for flowing steam at substantially uniform velocity about the outlets in opposite axial directions.

DETAILED DESCRIPTION OF THE INVENTION

Figure 1:
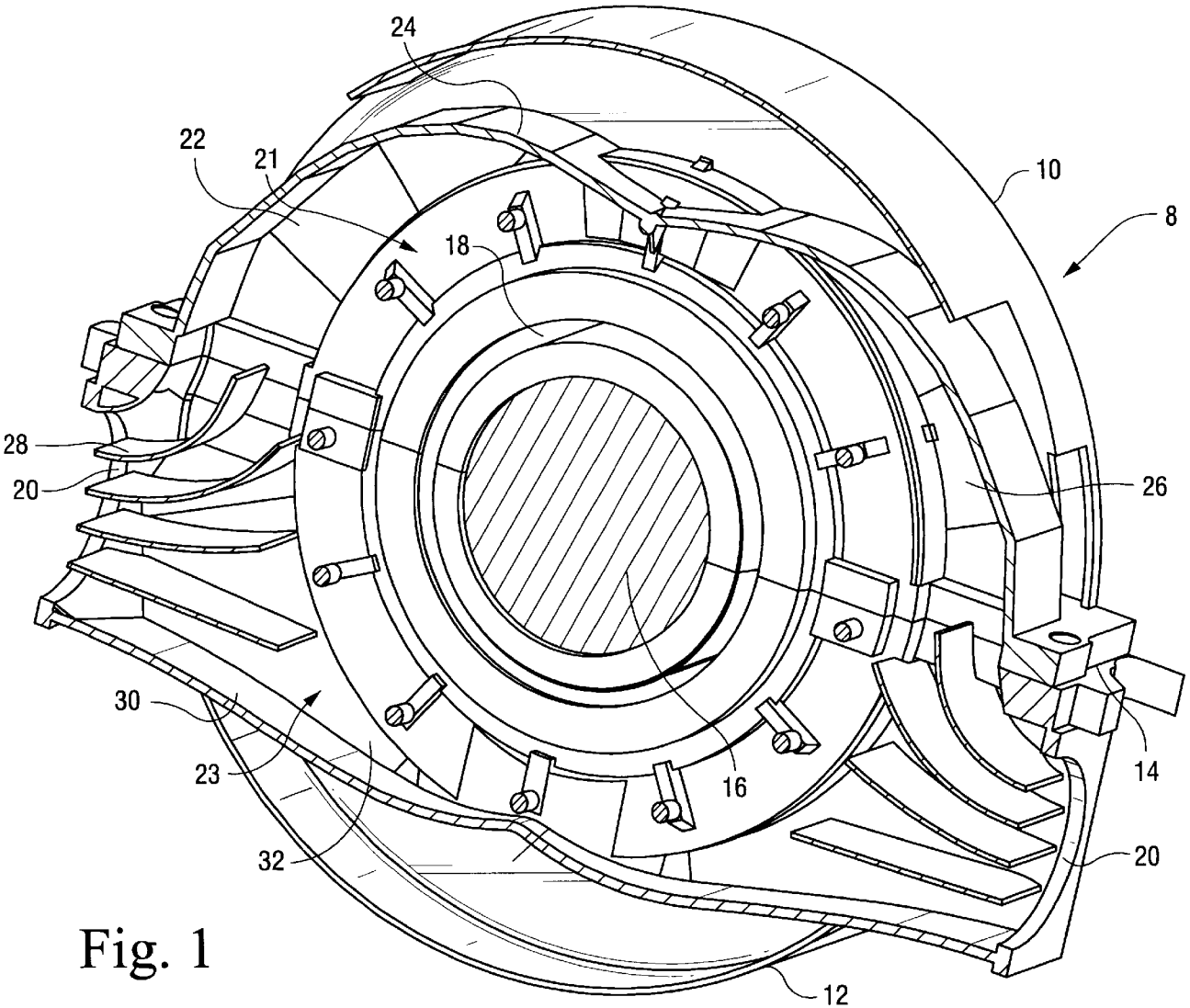
FIG. 1 is a perspective view of an interior of a steam inlet casing in accordance with a preferred embodiment of the present invention and taken along a vertical plane normal to the axis of rotation of the turbine rotor.
Figure 2:
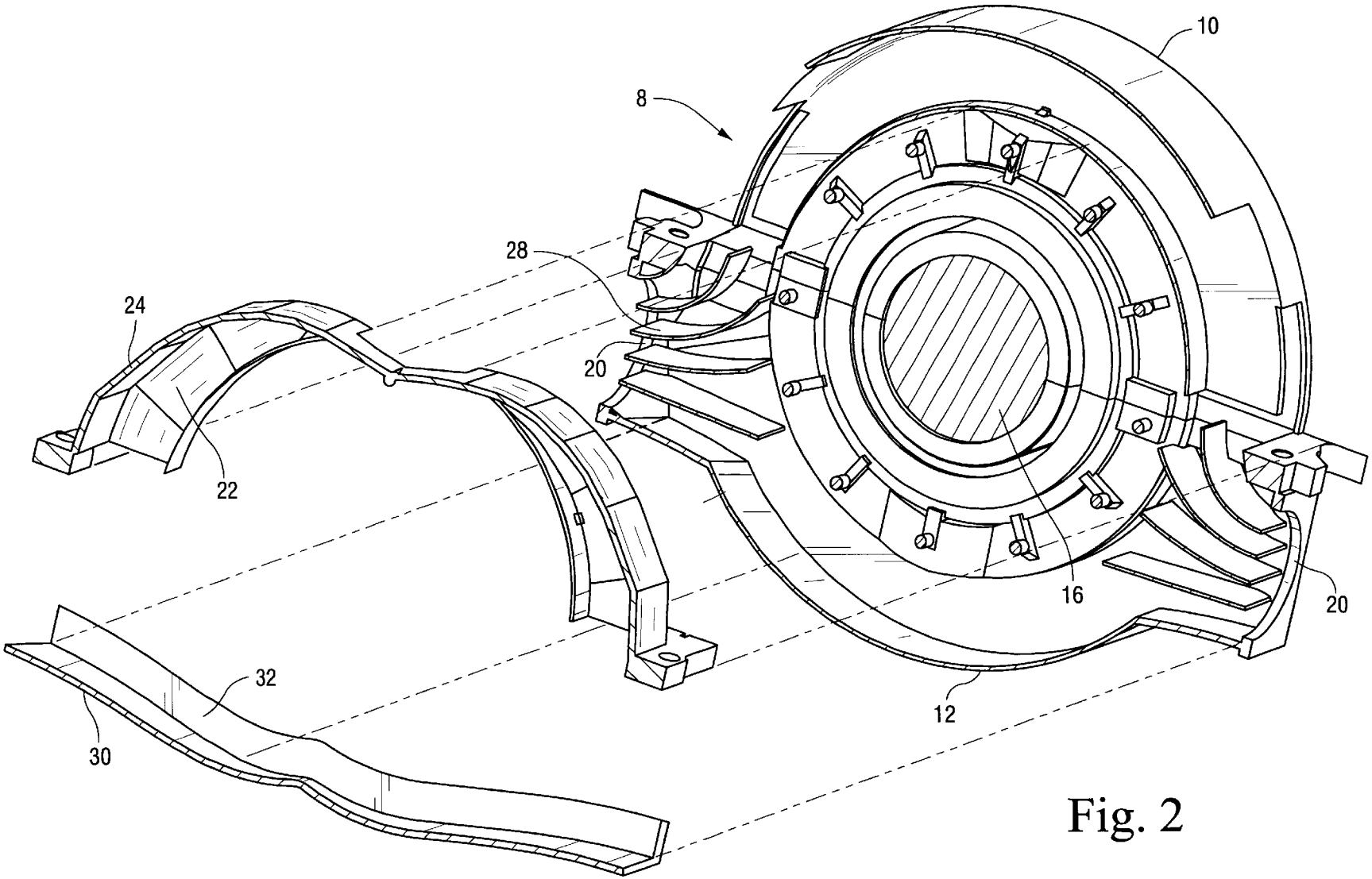
FIG. 2 is an exploded view of the casing of FIG. 1.

Referring now to FIG. 1, there is illustrated a turbine housing, generally designated 8 and including upper and lower turbine housing sections 10 and 12, respectively, joined along a horizontal midline 14 to one another and surrounding a rotor shaft 16. It will be appreciated that the upper and lower sections 10 and 12 extend axially unitarily in opposite axial directions and, in this illustrated embodiment, form part of a split flow axial steam turbine in which axially opposite stages of the turbine receive steam through annular axial passages or outlets 18. The upper and lower housing sections 10 and 12 define steam inlet ports 20 along opposite sides of the turbine housing 8. For a low pressure steam turbine, the inlet ports 20 receive high pressure steam from a high pressure section, not shown, for flow in a generally annular chamber 22 about the rotor 16.

A portion 21 of the generally annular chamber 22 in the upper housing section 10 is defined by an outer peripheral wall 24 and a pair of axially spaced side walls 26. Guide vanes 28 are provided in each of the inlet ports 20 for guiding the steam into the generally annular chamber 22. The portion of the generally annular chamber 22 in the lower housing section 12 is defined by an outer peripheral wall 30 and a pair of side walls 32. It will be appreciated that with the steam inlet ports along opposite sides of the housing 8, the steam at each inlet port is divided for flow into the upper section 10 and into the lower section 12, i.e., into the upper and lower chamber portions 21 and 23, respectively. The steam flows generally in a circumferential direction and radially inwardly where it turns for flow axially through the axial outlets 18 into the first stages of the turbine.

In accordance with a preferred embodiment of the present invention, the chambers 21 and 23 in the upper and lower sections 10 and 12, respectively, are divided into arcuate flow passages progressively of decreasing cross-sectional area from inlet ports 20 toward a medial location between the inlet ports and along the generally annular chamber. For example, the chamber 21 in the upper housing section 10 is divided into two arcuate flow paths, approximately 90° in circumferential length. To provide a progressively decreasing constant cross-sectional area, the walls 22 defining the arcuate flow passage on opposite sides of the chamber portions converge toward one another in a direction away from the associated inlet port 20. Alternatively, the outer peripheral wall 24 extends from the inlet port 20 along a radially inwardly arcuate directed path to form a passage of decreasing cross-section, i.e., forms a pair of involutes. Preferably, both the side walls 22 and the outer peripheral wall 24 converge toward one another and toward the axis, respectively, such that the flow area decreases linearly in cross-section from the inlet port affording a uniform mass flow and velocity in the upper chamber 21. As illustrated in FIG. 1, a pair of such arcuate flow paths are provided in the upper housing section 10 with the minimum cross-sectional area of the flow passages being defined at the juncture of the side walls and peripheral walls of each of the flow passages substantially medially between the inlet ports 20, e.g., at a vertical plane through the rotor axis.

Referring to the lower housing section 12, similar arcuate flow passages are provided. Because the inlet ports are provided along opposite sides of the lower housing section 12 adjacent the horizontal midline 14, the arcuate passages in the lower housing section 12 are somewhat shorter in circumferential length than the arcuate flow passages in the upper housing section 10. These passages, however, also progressively decrease in constant cross-sectional area in a circumferential direction away from the inlet ports. The decrease in cross-sectional area is effected by extending the peripheral wall 30 progressively radially inwardly in a direction away from the inlet port to a location of minimum cross-sectional area substantially medially between the inlet ports, i.e., a pair of involutes are formed. Alternatively, the side walls defining the arcuate passages in the lower housing section 10 may progressively converge toward one another in a circumferential direction away from the inlet port. Preferably, as with the upper section 10, the peripheral wall and side walls of the lower chamber defining the arcuate flow passages extend radially inwardly and converge, respectively, to define linearly decreasing cross-sectional area passages affording uniform mass flow and velocity about the lower section.

Figure 4:
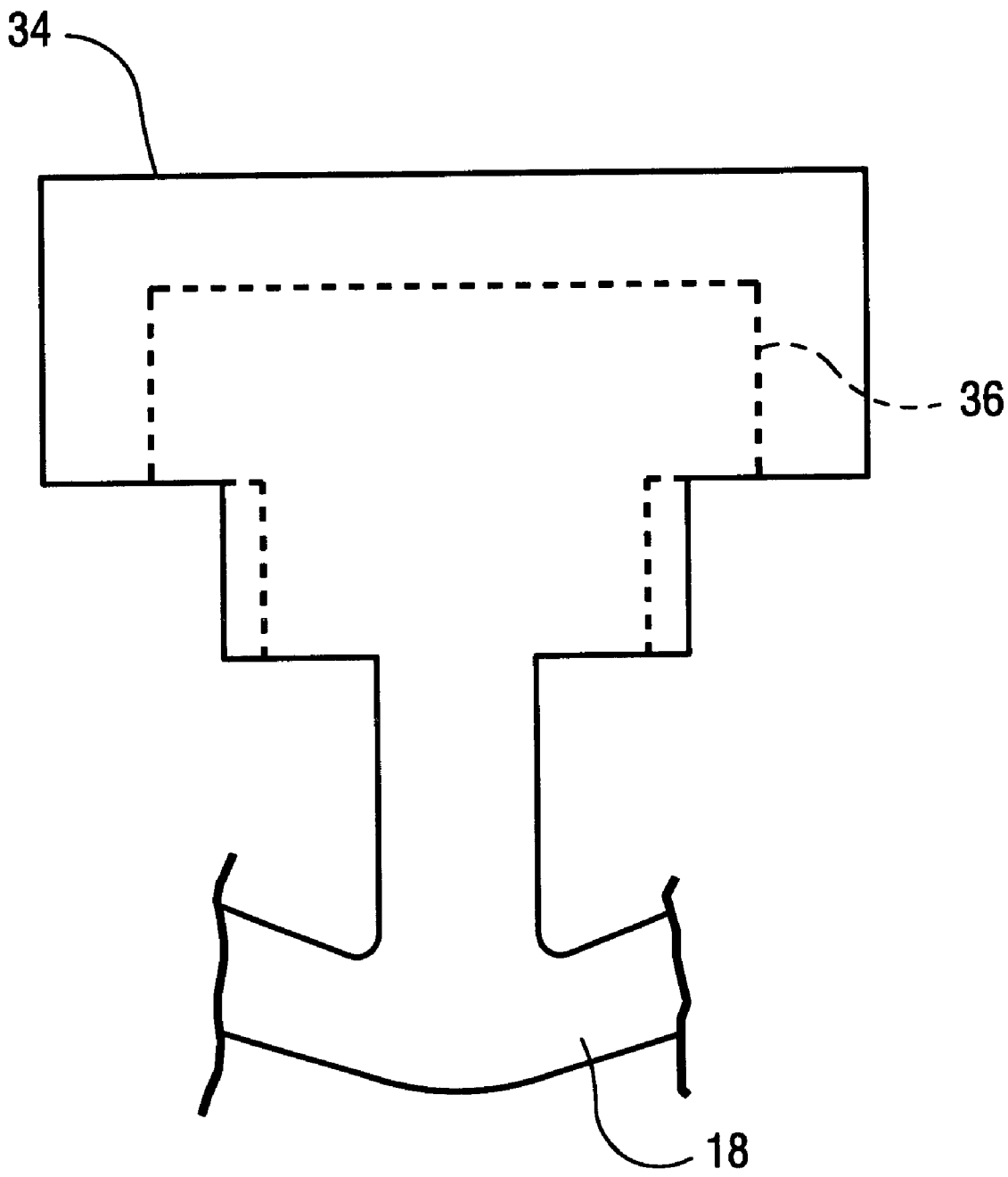
FIG. 4 is a schematic illustration of the cross-section of an upper half of a turbine housing illustrating the reduction in cross-sectional area as compared with prior art inlet annulus of constant cross-section.
Figure 5:
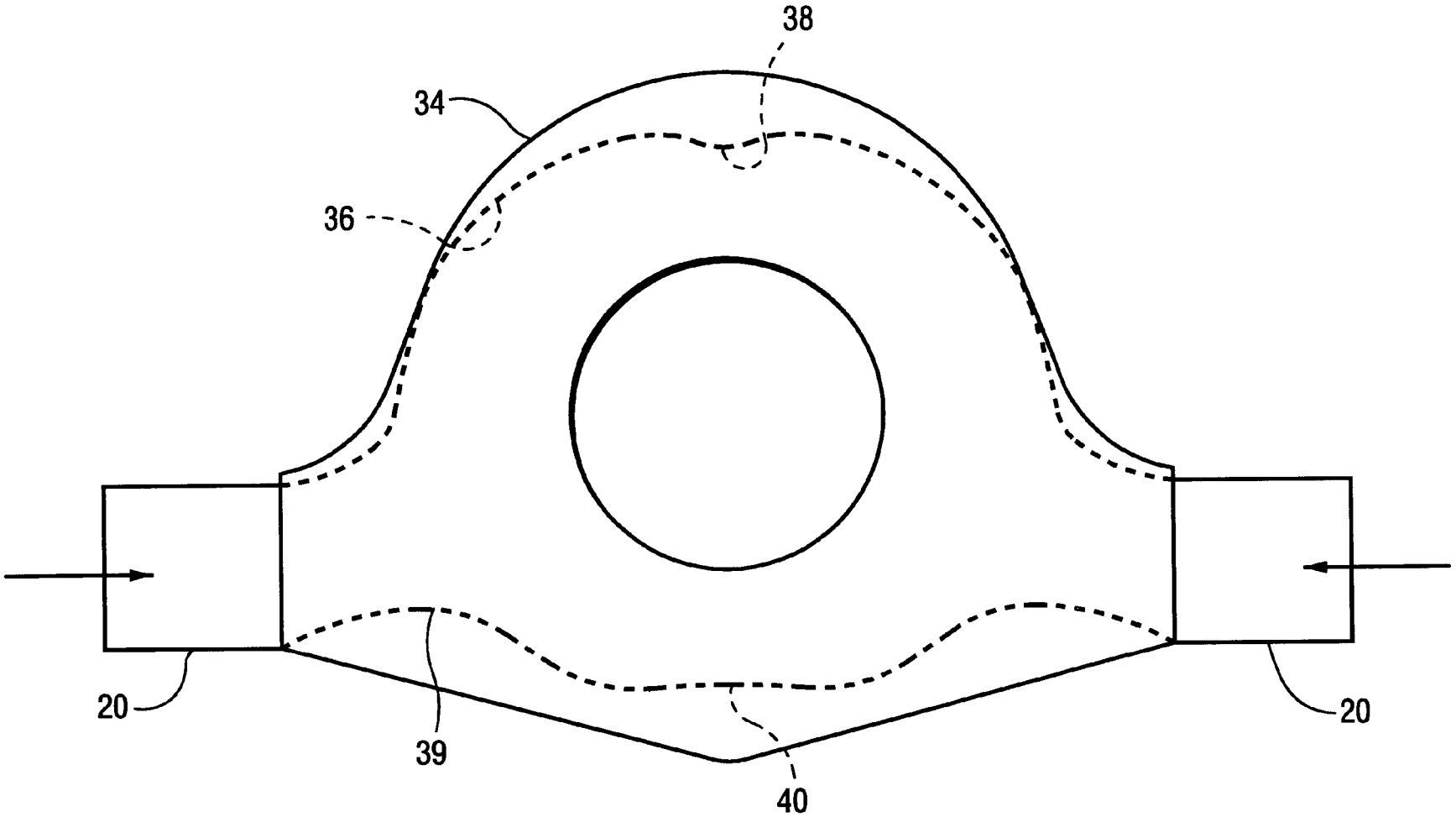
FIG. 5 is a schematic illustration of the reduced cross-sectional areas of the inlet as compared with the constant cross-sectional areas of the prior art.
Figure 6:
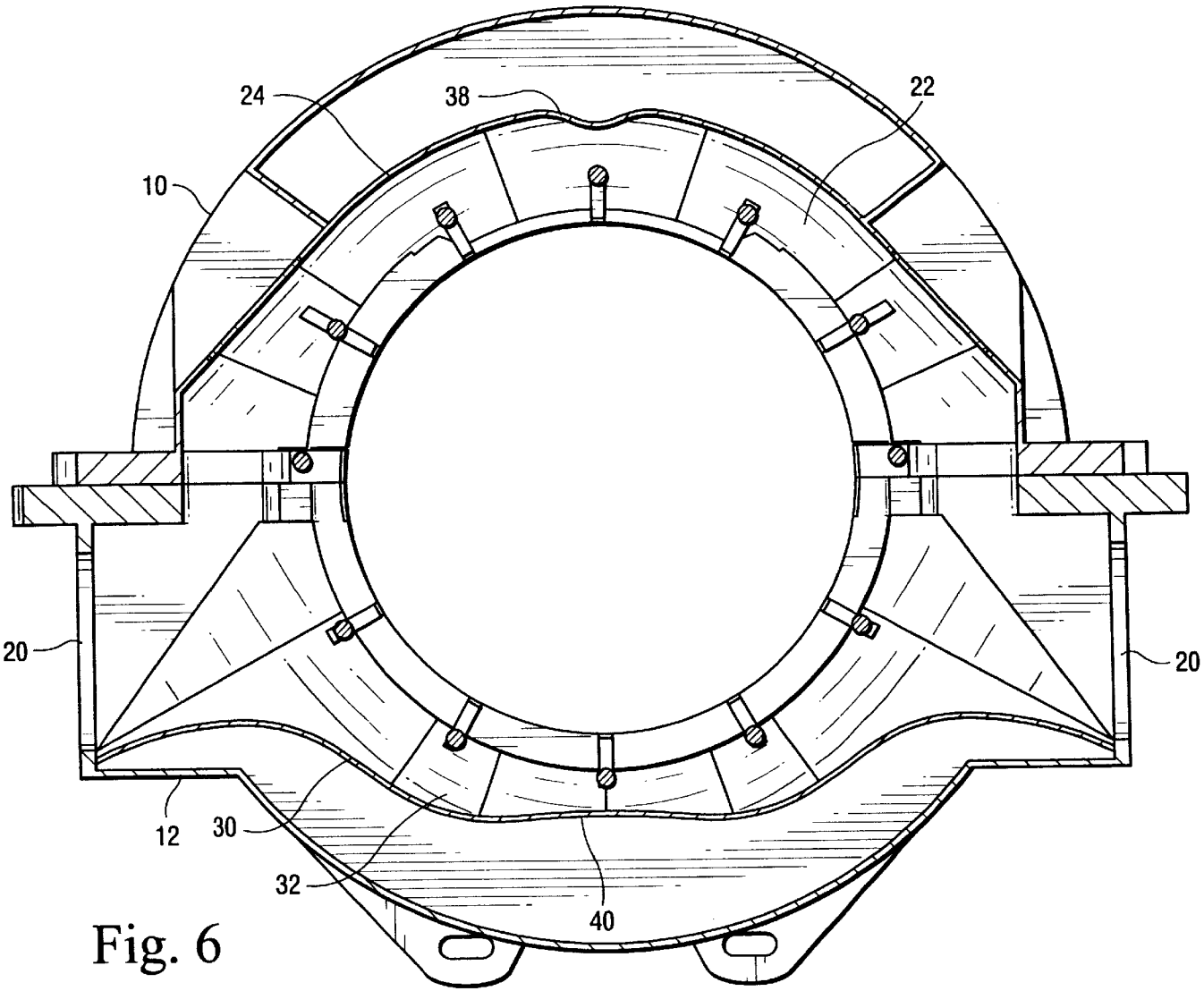
FIG. 6 is an axial cross-sectional view of the inlet according to a preferred embodiment of the present invention.

Referring to FIGS. 4 and 5, it will be appreciated that the inlet design described above is in contrast to the constant cross-sectional annular area typically provided as the inlet for an axial flow steam turbine. In FIGS. 4 and 5, the solid lines 34 represent the constant cross-sectional area of a prior art inlet, while the dashed lines 36 represent the decrease in cross-sectional area at a specified circumferential location about the generally annular inlet in accordance with a preferred embodiment of the present invention. It will be seen in FIG. 5 that the peripheral wall 24 represented by the dashed lines 36 forms an inwardly directed apex 38 substantially medially between the inlet ports 20 at the location of minimum cross-sectional area. Similarly, the lower peripheral wall 30, represented by dashed lines 39 in FIG. 5, forms an apex 40 substantially medially between the inlet ports 20.

As noted previously, it is highly desirable to provide uniform mass flow and velocity in a radial inward direction and then in an axial direction for flow to the first stages of the turbine. Because the area decreases progressively from the inlet ports about each of the flow passages in the upper and lower housing sections 10 and 12, respectively, the mass flow and velocity may remain substantially constant at each circumferential location about the periphery of the rotor and hence the axial flow into the first stage(s) is substantially uniform and at constant velocity.

Figure 3:
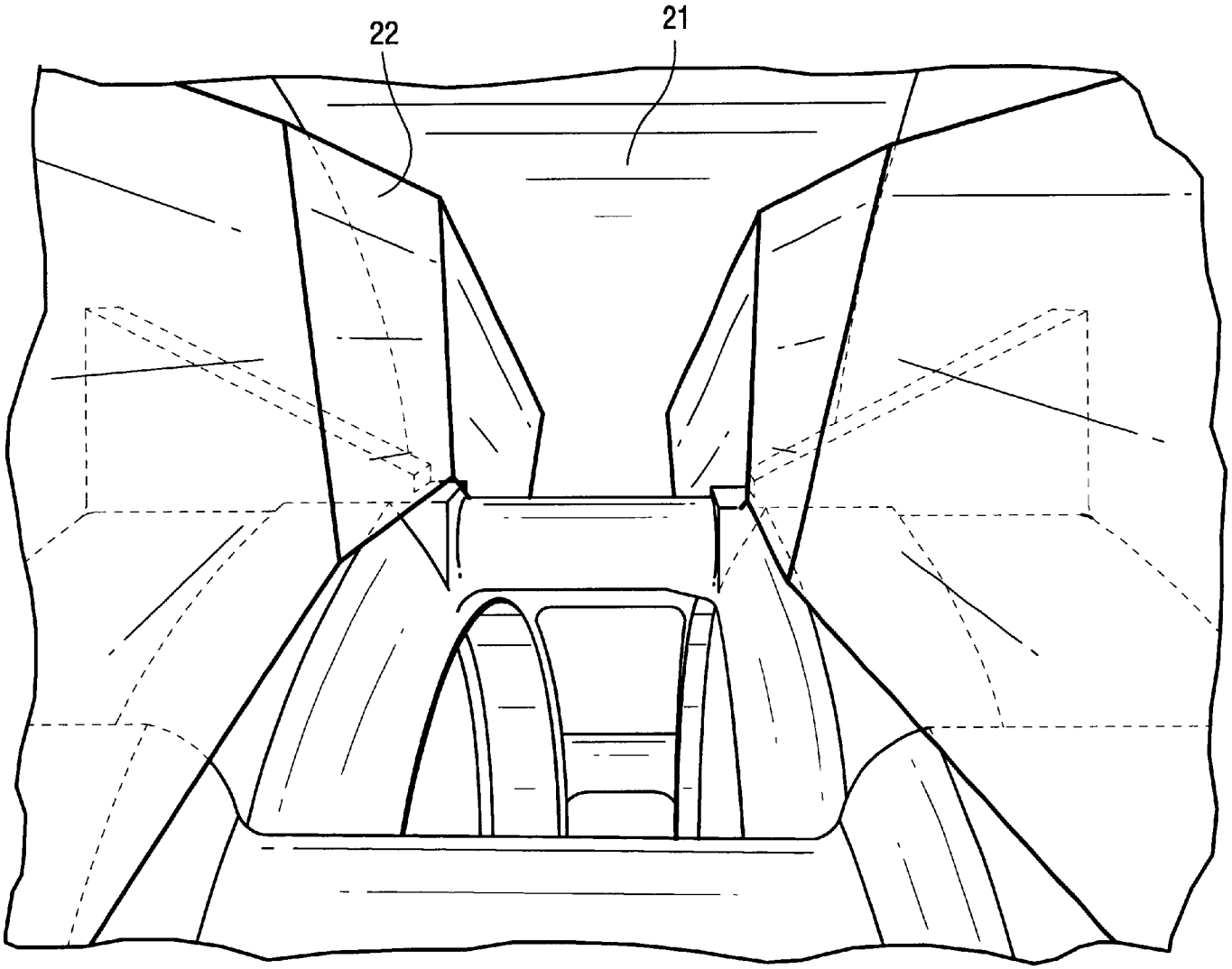
FIG. 3 is a fragmentary cross-sectional view looking circumferentially about the annular chamber.

In accordance with a preferred embodiment of the present invention, the inlet hereof may be provided as part of original equipment or as a retrofit in existing steam turbines. As part of the original equipment, the walls, both the side and peripheral walls defining the flow passages of decreasing cross-sectional area from the inlet ports toward their medial locations can be integrally formed within the housing sections 10 and 12 upon initial manufacture. It will also be appreciated that the peripheral walls 24 and 30 need not be provided separately from the walls of the housings 10 and 12 but may be formed integrally, i.e., cast with the walls of housings 10 and 12. Where a retrofit is desired, the peripheral walls 24 and side walls 22 may be formed as unitary sections. For example, a unitary section may comprise the side wall portions and the peripheral wall portion forming one of the upper quadrants of an arcuate flow passage of decreasing cross-section and installed as a unit into an existing steam turbine. A second section is then similarly installed in the upper housing 10 and the sections joined. Similarly, one section comprised of walls 30 and 32 may be provided in the lower housing section 12 or a pair of such unitary sections may be provided. As further alternative for retrofitting existing steam turbines with an inlet according to the present invention, the walls defining the arcuate flow passages of progressively decreasing cross-sectional area can be applied individually, for example, as individual steel plates, to the existing housing. This is illustrated in FIG. 3, wherein the individual steel plates for the side walls are designated 22. Similarly, the peripheral walls 24 can be built up from individual plates and welded into the sections 10 and 12.

In accordance with a preferred embodiment of the present invention, the inlet hereof may be provided as part of original equipment or as a retrofit in existing steam turbines. As part of the original equipment, the walls, both the side and peripheral walls defining the flow passages of decreasing cross-sectional area from the inlet ports toward their medial locations can be integrally formed within the housing sections 10 and 12 upon initial manufacture. It will also be appreciated that the peripheral walls 24 and 30 need not be provided separately from the walls of the housings 10 and 12 but may be formed integrally, i.e., cast with the walls of housings 10 and 12. Where a retrofit is desired, the peripheral walls 24 and side walls 22 may be formed as unitary sections. For example, a unitary section may comprise the side wall portions and the peripheral wall portion forming one of the upper quadrants of an arcuate flow passage of decreasing cross-section and installed as a unit into an existing steam turbine. A second section is then similarly installed in the upper housing 10 and the sections joined. Similarly, one section comprised of walls 30 and 32 may be provided in the lower housing 12 or a pair of such unitary casings may be provided. As further alternative for retrofitting existing steam turbines with an inlet according to the present invention, the walls defining the arcuate flow passages of progressively decreasing cross-sectional area can be applied individually, for example, as individual steel plates, to the existing housing. This is illustrated in FIG. 3, wherein the individual steel plates for the side walls are designated 22. Similarly, the peripheral walls 24 can be built up from individual plates and welded into the housings 10 and 12.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a steam turbine, a steam inlet comprising:

a generally annular housing having an outer surrounding peripheral wall and a pair of axially spaced side walls extending inwardly to define a generally annular chamber within said housing and at least one generally annular steam outlet generally centrally of the housing in communication with said chamber for flowing steam axially outwardly through said outlet into the first stage of the turbine;

a pair of steam inlet ports spaced from one another about said housing for receiving steam and transmitting steam into the chamber;

said chamber having substantially progressive reductions in cross-sectional areas in generally opposite circumferential directions away from said steam inlet ports to provide a substantially uniform flow of steam about the chamber in a generally radially inward direction.

2. A steam inlet according to claim 1 including guide vanes in said inlet ports for guiding the steam in opposite directions about the chamber from said inlet port.

3. A steam inlet according to claim 1 wherein said reductions in cross-sectional areas afford a generally uniform radial inward velocity of steam about said chamber.

4. A steam inlet according to claim 1 wherein said reductions in cross-sectional areas afford a generally uniform axial flow of steam at said axial outlet.

5. A steam inlet according to claim 1 including a second steam outlet generally centrally of said housing for flowing steam from said chamber in an axial direction opposite the axial direction of the steam flowing through the first mentioned steam outlet.

6. A steam inlet according to claim 1 wherein said reductions in cross-sectional areas afford a generally uniform radial inward velocity of steam about said chamber and a substantially uniform axial flow at said outlets.

7. A steam inlet according to claim 1 wherein said annular housing includes upper and lower housing sections, each section including a pair of arcuate flow passages decreasing in cross-sectional area in a direction away from respective inlet ports terminating in a minimum cross-sectional area generally medially between said inlet ports.

8. In a split flow axial steam turbine, a steam inlet comprising:

a generally annular housing having an outer surrounding peripheral wall and a pair of axially spaced side walls extending inwardly from said outer wall to define a generally annular chamber within said housing;

a pair of steam inlet ports spaced from one another about the housing for receiving steam and flowing the received steam into said chamber;

a pair of axially spaced, generally annular steam outlets in communication with said chamber for flowing steam in opposite axial directions through said outlets to stages of said turbine;

said chamber having progressive reductions in cross-sectional areas in generally opposite circumferential directions away from said steam inlet ports to provide a generally uniform flow of steam from the chamber through and about said steam outlets.

9. A steam inlet according to claim 8 wherein said annular housing includes upper and lower housing sections, each section including a pair of arcuate flow passages decreasing in cross-sectional area in a direction away from respective inlet ports terminating in a minimum cross-sectional area generally medially between said inlet ports.

10. A steam inlet according to claim 8 wherein the reductions in cross-sectional areas afford a generally uniform radial inward velocity of steam about said chamber and a generally uniform axial velocity of said steam about said steam outlets in opposite axial directions.

11. A steam inlet according to claim 8 wherein the cross-sectional area of the chamber decreases to minimum cross-sections at locations substantially medially between said steam inlet ports along opposite circumferential steam flow paths in said annular chamber.

12. In a split flow axial steam turbine having a housing with an annulus for receiving steam from a pair of circumferentially spaced steam inlet ports and a pair of axially spaced steam outlets radially inwardly of said annulus for receiving steam from said annulus for flow in opposite axial directions to stages of the turbine, a retrofit steam chamber for said annulus, comprising:

a plurality of generally arcuate unitary sections each having an outer peripheral wall and a pair of axially spaced side walls extending inwardly from said outer wall to define a generally arcuate passage;

said arcuate unitary sections being disposed within said annulus in communication with said steam inlet ports, respectively;

each of said arcuate passages having a progressive reduction in cross-sectional area in a generally circumferential direction away from said steam inlet ports to provide a generally uniform flow of steam from the chamber through and about said steam outlets.

13. A retrofit steam chamber according to claim 12 wherein the cross-sectional area of the chamber decreases to minimum cross-sections at locations substantially medially between said steam inlet ports along opposite circumferential steam flow paths in said annular chamber.

14. In a split flow axial steam turbine having a housing with an annulus for receiving steam from a pair of circumferentially spaced steam inlet ports and a pair of axially spaced steam outlets radially inwardly of said annulus for receiving steam from said annulus for flow in opposite axial directions to stages of the turbine, a method of retrofitting a steam inlet to obtain a generally uniform velocity of steam flowing axially through and about said steam outlets, comprising the steps of:

forming a plurality of arcuate housing sections each having an outer peripheral wall and a pair of axially spaced side walls extending inwardly from said outer wall to define a generally arcuate steam flow passage of decreasing cross-sectional area from one end to an opposite end;

installing said housing sections as unitary sections or as discrete peripheral walls and side walls in said annulus of said housing with larger cross-sectional ends thereof in communication with said inlet ports and with passages in communication with the axial steam outlets for flowing steam at substantially uniform velocity about said outlets in opposite axial directions.

15. A method according to claim 14 including installing said housing sections within said housing as unitary sections.

16. A method according to claim 14 including installing said discrete walls in said housing to form said sections within said housing.

* * * * *

UNITED STATES PATENT AND TRADEMARK OFFICE

CERTIFICATE OF CORRECTION

PATENT NO. : 6,609,881 B2
DATED : August 26, 2002
INVENTOR(S) : Brown et al.

It is certified that error appears in the above-identified patent and that said Letters Patent is hereby corrected as shown below:

Delete the paragraph commencing on column 5, line 54 and concluding on column 6, line 16, in its entirety.

Signed and Sealed this

Twenty-eighth Day of October, 2003

JAMES E. ROGAN
*Director of the United States Patent and Trademark Office*